US005243945A

United States Patent [19]

Katoh et al.

[11] Patent Number: 5,243,945

[45] Date of Patent: Sep. 14, 1993

[54] FUEL INJECTION SYSTEM FOR THE INTERNAL COMBUSTION ENGINE

[75] Inventors: Masahiko Katoh; Masanori Takahashi, both of Hamamatsu, Japan

[73] Assignee: Sanshin Kogyo Kabushiki Kaisha, Hamamatsu, Japan

[21] Appl. No.: 872,182

[22] Filed: Apr. 22, 1992

[30] Foreign Application Priority Data

Apr. 22, 1991 [JP] Japan ..... 3-116593

[51] Int. Cl.[5] ..... F02M 67/02

[52] U.S. Cl. ..... 123/533

[58] Field of Search ..... 123/179.16, 179.17, 123/491, 531, 533, 532, 534

[56] References Cited

U.S. PATENT DOCUMENTS 1,409,093 3/1922 Grant ..... 123/532
4,077,381 3/1978 Firey ..... 123/179.16
4,674,462 6/1987 Koch et al. ..... 123/531
4,867,115 9/1989 Henein ..... 123/179.17
5,016,598 5/1991 Kushibe et al. ..... 123/179.17

FOREIGN PATENT DOCUMENTS 56-27064 3/1981 Japan ..... 123/179.17
3-15655 1/1991 Japan ..... 123/491

*Primary Examiner*—Andrew M. Dolinar
*Attorney, Agent, or Firm*—Ernest A. Beutler

[57] ABSTRACT

A fuel system for an internal combustion engine wherein the supply of fuel by the fuel injector during starting is precluded until it is ensured that complete combustion will occur in the combustion chamber. This avoids fuel wastage, undesirable exhaust emissions and spark plug wetting. The condition when complete combustion will occur is sensed by sensing pressure in the induction system of the engine or by engine speed.

13 Claims, 3 Drawing Sheets

ECU - 83

FUEL INJECTION SYSTEM FOR THE INTERNAL COMBUSTION ENGINE

BACKGROUND OF THE INVENTION

This invention relates to a fuel injection system for an internal combustion engine and more particularly to an improved fuel injection system and control therefor that prevents the injection of fuel during starting at a time when combustion is not likely to occur.

As is well known, engine starting is a relatively difficult procedure. During starting the engine is cranked at a very low speed and fuel is supplied to the engine for starting purposes. However, there may be some instances when the fuel supply is premature and that the fuel introduced to the engine will not burn during the initial starting procedure. If this occurs, not only will fuel be wasted, but the spark plug of the engine can be wetted by the fuel and subsequent firing of the spark plug will not effect a spark and combustion.

For example, with supercharged engines, the supercharger may not deliver adequate air to the engine for combustion during initial cranking. If fuel is supplied during this time, the fuel can foul the spark plug and provide poor fuel economy and difficulties in starting.

It is, therefore, a principal object of this invention to provide an improved fuel supply system for an internal combustion engine wherein the fuel will not be supplied to the engine during starting until conditions exist where it will be ensured that the fuel will be burned when the spark plug is fired.

It is a further object of this invention to provide an improved method for starting an internal combustion engine.

It is a further object of this invention to provide a method of operating a fuel injected internal combustion engine and method of operating it wherein fuel will not be injected during starting until it will be ensured that combustion will occur.

SUMMARY OF THE INVENTION

This invention is adapted to be embodied in a fuel supply system for an internal combustion engine comprised of a charge former for supplying fuel to the engine for combustion therein. Means are provided for controlling the fuel supply by the charge former. Means are also provided for sensing a condition during the starting of the engine when the supply of fuel may not cause complete combustion of the fuel. In accordance with this feature of the invention, means is provided for precluding the supply of fuel until the condition does not exist.

A further feature of this invention is adapted to be embodied in a method of operating a fuel supply system for an internal combustion engine that comprises a charge former for supplying the fuel to the engine for combustion therein. Control means are provided for controlling the supply of fuel. Means are incorporated for sensing a condition during the starting of the engine in which the supply of fuel may not cause complete combustion of the fuel. In accordance with this method the engine is started and the sensing of the condition is initiated. When the condition no longer exists, then the supply of fuel is initiated.

DETAILED DESCRIPTION OF THE PREFERRED EMBODIMENTS OF THE INVENTION

Figure 1:
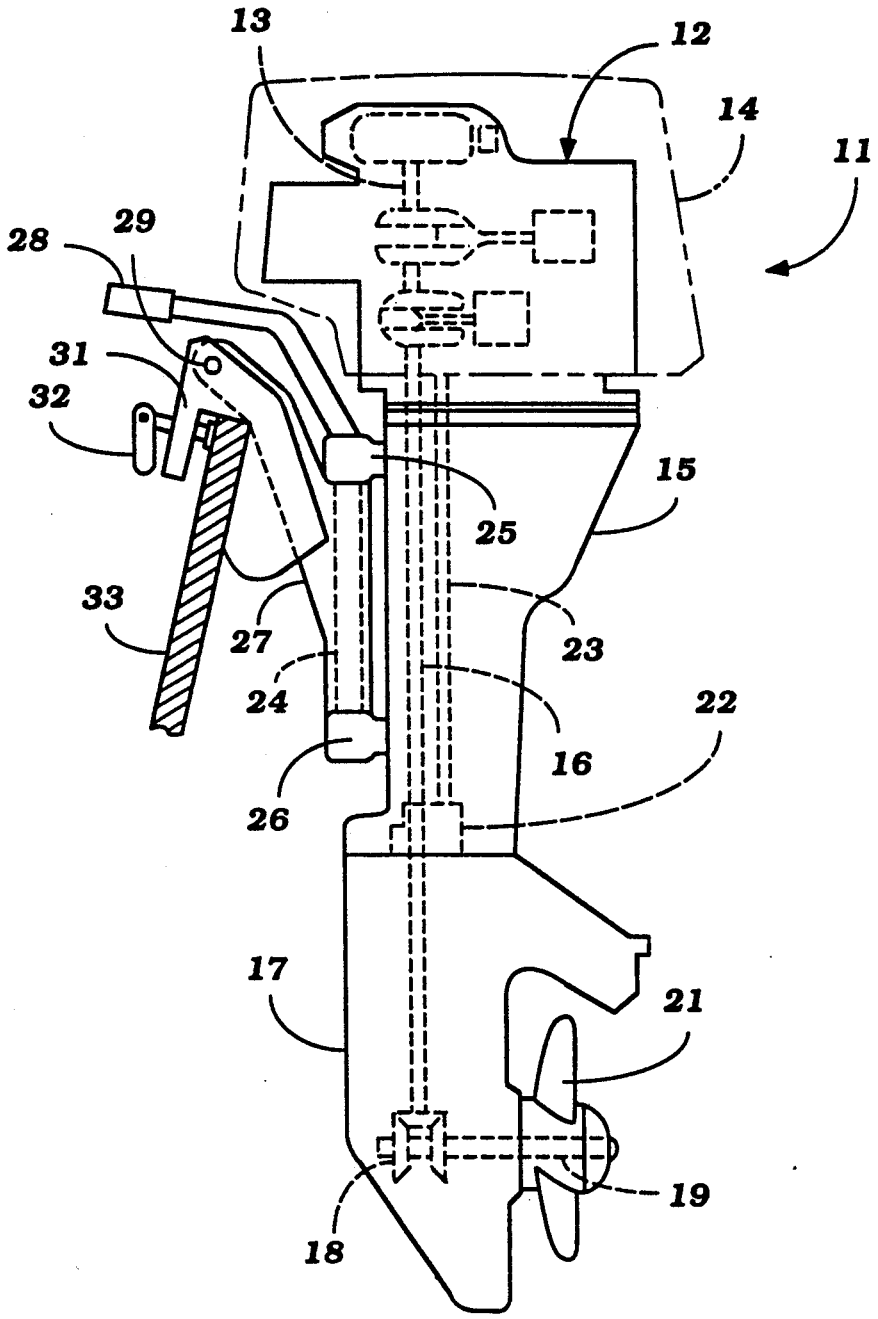
FIG. 1 is a side elevational view of an outboard motor constructed in accordance with an embodiment of the invention.

Referring first to FIG. 1, an outboard motor constructed in accordance with an embodiment of the invention is identified generally by the reference numeral 11. The invention is described in conjunction with an outboard motor because such outboard motors are, at times, powered by internal combustion engines having scavenge pumps and fuel injection systems. It is to be understood, however, that the invention may be employed with any application for an internal combustion engine.

The engine is shown schematically in FIG. 1 and is identified generally by the reference numeral 12. The construction of the engine 12 will be described in more detail later by reference to FIG. 2 but it will be noted that in the illustrated embodiment, the engine 12 is of the two cylinder in-line type. The engine 12 has a crankshaft 13 which is rotatably journaled, as is typical with two cycle engine practice, for rotation about a vertically extending axis. A protective cowling, shown in phantom and identified by the reference numeral 14, encircles and protects the engine 12 and completes the power head of the outboard motor.

A driveshaft housing 15 depends from the power head thus far described and rotatably journals a driveshaft 16 that is coupled in a suitable manner to the engine crankshaft 13. This driveshaft 16 depends into a lower unit 17 that contains a conventional type of forward/neutral/reverse transmission 18 for driving a propeller shaft 19 and propeller 21 affixed thereto in a known manner.

In the illustrated embodiment, the engine 12 is water cooled and, as is typical with outboard motor practice, a water pump 22 is affixed between the driveshaft housing 15 and lower unit 17 and is driven by the driveshaft 16 for supplying cooling water from the body of water in which the outboard motor is operating to the water jacket of the engine 12 through a water supply conduit 23.

A steering shaft 24 is affixed to the driveshaft housing 15 by upper and lower brackets 25 and 26 and is journaled for rotation within a swivel bracket 27 for steering of the outboard motor 11 by means of a tiller 28 that is affixed to the upper end of the steering shaft 24.

The swivel bracket 27 is pivotally connected by means of a pivot pin 29 to a clamping bracket 31 that carries a clamping device 32. The clamping device 32 permits the outboard motor 11 to be attached to a transom (shown partially in cross section at 33) of an associated watercraft. The pivotal connection between the swivel bracket 27 and clamping bracket 31 permits tilt and trim movement of the outboard motor 11 as is well known in this art.

Figure 2:
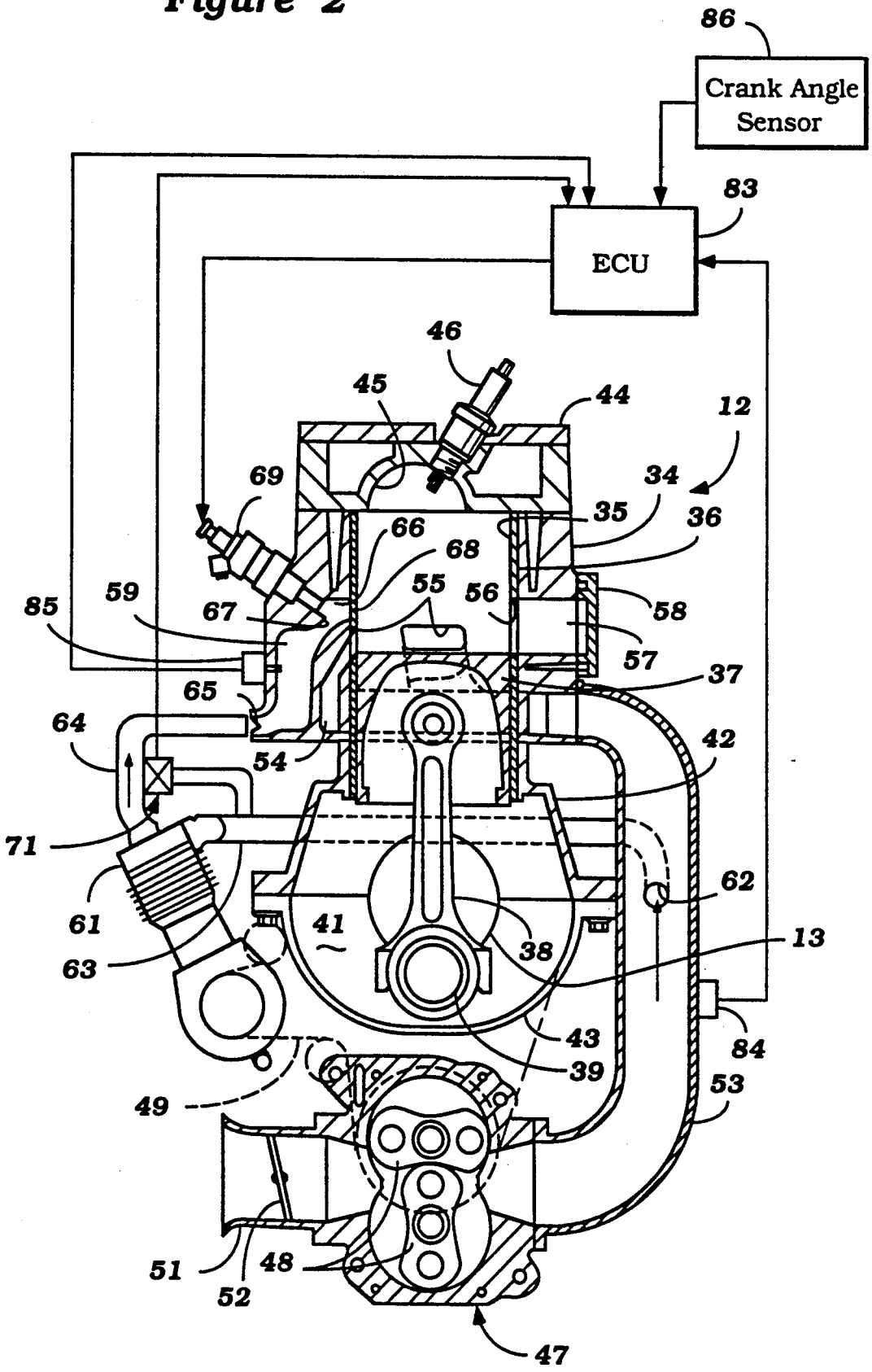
FIG. 2 is a cross-sectional view taken through a cylinder of the engine of the outboard motor and shows other components schematically.

Referring now to FIG. 2, the construction of the engine 12 will be described in greater detail. It should be noted that the engine 12 is depicted by a cross section through a single of its cylinders and it is believed that those skilled in the art can readily understand from the following description how the invention is applied to a multiple cylinder engine.

The engine 12 is comprised of a cylinder block 34 having a pair of aligned cylinder bores 35 formed by pressed or cast in liners 36. Pistons 37 reciprocate in each of the cylinder bores 35 and are connected by means of connecting rods 38 to the throws 39 of the crankshaft 13. The crankshaft 13 is journaled for rotation within a crankcase chamber 41 formed by a skirt 42 of the cylinder block 34 and a crankcase member 43 that is affixed to the cylinder block skirt 42 in an appropriate manner.

A cylinder head assembly 44 is affixed to the cylinder block 35 in a suitable manner and has a pair of recesses 45 which cooperate with each of the cylinder bores 35 and pistons 37 to form the respective combustion chambers of the engine. Spark plugs 46 are mounted in the cylinder head assembly 44 and protrude into the recess 45 for firing the charge therein in a well known manner.

The engine 12 operates on a two stroke principle and its air charge is supplied by an induction system that includes a positive displacement compressor, indicated generally by the reference numeral 47. The compressor 47 is provided with a pair of intermeshing impellers 48 that are driven from the crankshaft 13 in a suitable manner, as by means of a toothed belt or chain 49.

The compressor 47 draws an air charge from within the protective cowling 14 through a throttle body 51 in which a throttle valve 52 is positioned for controlling the speed of the engine 12. The compressor 47 discharges the compressed air charge into an air manifold 53 that supplies a scavenge manifold 54 which encircles each of the cylinder bores 35 and which delivers a compressed air charge thereto through a plurality of circumferentially spaced scavenge ports 55. In the illustrated embodiment, there is one center scavenge port and a pair of side scavenge ports, although other forms of scavenging may be employed. It should be noted that the cylinder head recess 45 is offset toward the side of the cylinder bore 35 where the scavenge ports 55 are located.

An exhaust port 56 opens through the cylinder liner 36 in opposing relationship to the center scavenge port 55 and communicates with an exhaust manifold 57 formed in the cylinder block 34 as is well known in outboard motor practice. A cover plate 58 closes the exhaust manifold 57. The exhaust gases are discharged downwardly from the cylinder block 34 into an exhaust system (not shown) contained within the driveshaft housing 15 for silencing and cooling the exhaust gases before their discharge to the atmosphere. This discharge may be through a conventional under water high speed exhaust gas discharge and an above the water low speed exhaust gas discharge as are commonly employed with outboard motors.

The engine 12 is provided with a fuel/air injection system for its operation of a type as is generally disclosed in our copending application entitled, "Fuel Injection System for Two Cycle Engine," Ser. No. 831,786 filed Feb. 5, 1992 and specifically FIG. 8 of that application, the disclosure of which is incorporated herein by reference.

Basically this injection system includes a first high pressure air chamber 59 which is supplied with a source of high pressure air from an air compressor 61 of the reciprocating type which is also driven from the crankshaft 13 by the belt 49. This compressor 61 draws air from the manifold 53 through an inlet opening 62 and conduit 63. The compressed air is discharged to the chamber 59 through a delivery conduit 64 and check valve 65. The check valve 65 permits the chamber 59 to be pressurized and precludes reverse flow.

The chamber 59 extends to a smaller chamber 66 with the chambers 59 and 66 communicating with each other through a restriction 67. A nozzle port 68 which is disposed above the center scavenge port 55 communicates the chamber 66 with the cylinder bore 35 when the piston 37 is spaced from its top dead center position.

A fuel injector 69 injects fuel into the chamber 66 which fuel will then be discharged along with the air pressure from the chamber 59 into the cylinder bore when the nozzle port 68 is opened and the fuel injector 69 injects fuel. The injection of fuel is done toward the time when the piston will be moving upwardly to again close the nozzle port, as best described in our co-pending application afore referred to.

Figure 3:
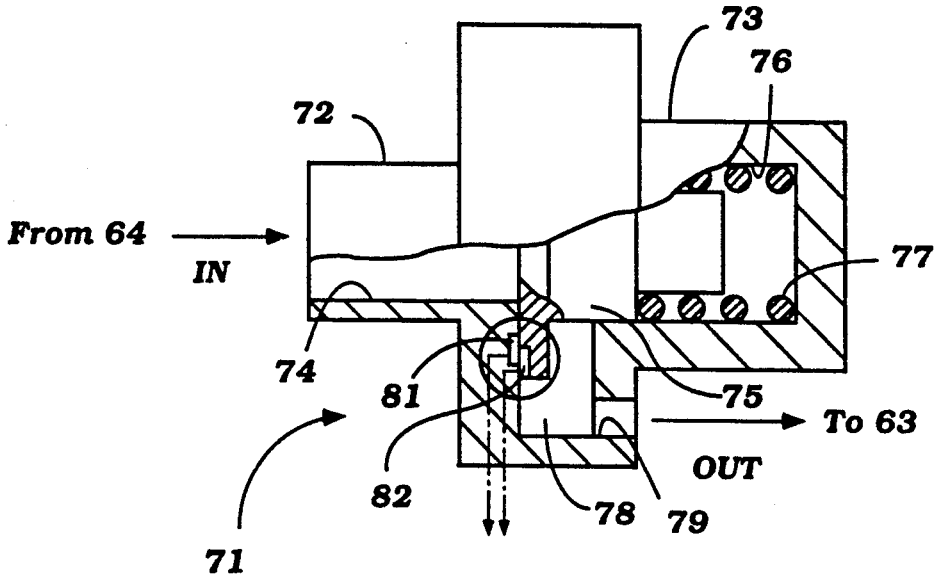
FIG. 3 is a cross-sectional view showing the air supply condition sensor employed in the embodiment.

A relief valve, indicated generally by the reference numeral 71 and having a construction as best shown in FIG. 3, is provided for limiting the air pressure delivered by the compressor 61 to the pressure chamber 59. The relief valve 71 includes an outer housing made up of a pair of generally cylindrical parts 72 and 73 that are connected to each other in a suitable manner. The part 72 forms an inlet fitting 74 that communicates with the conduit 64. A slidable piston 75 is supported within a bore 76 of the housing piece 73 and is normally urged to a closed position by a coil compression spring 77 contained at the base of the bore 76. The piston 75, when biased away from the opening 74, will open communication with a relief chamber 78 that communicates back with the conduit 63 through a relief passage 79.

A pair of contacts 81 and 82 are carried by the housing piece 72 and piston 75 respectively, to provide a signal to a controlling ECU 83 (FIG. 2) for a purpose to be described.

The relief valve 71 is normally closed but when sufficient pressure is generated by the compressor 61, the spring 71 will yield and permit control of the maximum air pressure generated in the chamber 59.

As has been mentioned before, during normal running of the engine, the fuel injector 69 will inject fuel into the chamber 66 which is discharged along with air under pressure through the nozzle port 68 to the combustion chamber for combustion when the spark plug 46 is fired. However, during cranking there is a time when the injection of fuel will not cause complete combustion in the combustion chamber due to the lack of adequate air supply. If cranking of the engine is continued along with injection of fuel from the injector 69 when such a condition exists, not only will starting not occur, but the plug 46 will be wetted and fouled so that when sufficient air is present, the engine still will not start because of plug fouling.

In order to avoid this, an arrangement is provided in the ECU 83 which controls the fuel injector 69 so as to preclude the injection of fuel until it can be ensured that complete combustion will occur when the spark plug 46 is fired. This condition can be sensed in a variety of manners. For example, a pressure sensor 84 may be provided in the manifold 53 which will sense when adequate air pressure is provided for complete combustion and then the ECU 83 will permit injection of fuel from the fuel injector 69. Alternatively, a pressure sensor 85 may be positioned in the pressure chamber 59 for the same purpose. Alternatively, the contacts 81 and 82 may provide an output into the ECU 83 which will cause fuel injection not to occur until the relief valve 71 is open, indicating that adequate pressure is present in the system for complete combustion.

As a further alternative, an engine speed sensor, such as a crank angle sensor 86 may be employed to provide the necessary signal to the ECU 83 to ensure that the injector 69 does not inject until the engine is being cranked at a speed high enough to generate adequate air pressure for complete combustion.

It should be readily apparent from the foregoing description that the described embodiments of the invention are extremely effective in ensuring that there will not be fuel wastage during premature attempts to start the engine and also that plug wetting will be avoided by preventing the injection of fuel until a time when the engine is in a condition that complete combustion will occur. Of course, the foregoing description is that of preferred embodiments of the invention and various changes and modifications may be made without departing from the spirit and scope of the invention as defined by the appended claims.

We claim:

1. A fuel supply system for supplying fuel to the combustion chamber of an internal combustion engine comprising an air chamber adapted to communication with said combustion chamber, a fuel injector for supplying fuel to said air chamber for combustion, control means for controlling the supply of fuel from said fuel injector, means for supplying an air charge under pressure to said air chamber, means for sensing the pressure of the air charge supply of fuel from said fuel injector until the pressure of air supplied to said chamber exceeds a predetermined value.

2. A fuel supply system for an internal combustion engine as set forth in claim 1 wherein the air chamber into which the fuel injector injects fuel communicates with the combustion chamber of the engine through nozzle port means formed in a component of the engine defining a variable volume chamber which is opened and closed by the movement of another component.

3. A fuel supply system for an internal combustion engine as set forth in claim 2 wherein the engine is a reciprocating engine and the component in which the air chamber is formed is a cylinder block and the other component is a piston.

4. A fuel supply system for an internal combustion engine as set forth in claim 3 wherein the means for supplying an air charge to the air chamber comprises a check valve permitting flow into the air chamber but precluding air flow out of the air chamber.

5. A fuel supply system for an internal combustion engine as set forth in claim 4 wherein the means for sensing the air pressure senses the air pressure upstream of the check valve.

6. A fuel supply system for an internal combustion engine as set forth in claim 4 wherein the means for sensing the air pressure senses the air pressure downstream of the check valve and within the air chamber.

7. A fuel supply system for an internal combustion engine as set forth in claim 5 wherein there is further provided an air compressor for delivering compressed air to the air chamber.

8. A fuel supply system for an internal combustion engine as set forth in claim 6 wherein there is further provided an air compressor for delivering compressed air to the air chamber.

9. A fuel supply system for an internal combustion engine as set forth in claim 1 wherein the means for supplying an air charge to the air chamber comprises a check valve permitting flow into the air chamber but precluding air flow out of the air chamber.

10. A fuel supply system for an internal combustion engine as set forth in claim 9 wherein the means for sensing the air pressure senses the air pressure upstream of the check valve.

11. A fuel supply system for an internal combustion engine as set forth in claim 9 wherein the means for sensing the air pressure senses the air pressure downstream of the check valve and within the air chamber.

12. A fuel supply system for an internal combustion engine as set forth in claim 10 wherein there is further provided an air compressor for delivering compressed air to the air chamber.

13. A fuel supply system for an internal combustion engine as set forth in claim 11 wherein there is further provided an air compressor for delivering compressed air to the air chamber.

* * * * *

UNITED STATES PATENT AND TRADEMARK OFFICE

CERTIFICATE OF CORRECTION

PATENT NO. : 5,243,945

DATED : Sept. 14, 1993

INVENTOR(S) : Masahiko Katoh, et al

It is certified that error appears in the above-indentified patent and that said Letters Patent is hereby corrected as shown below:

Column 5, line 28, Claim 1, "communication" should be --communicate--.

Column 5, line 34, Claim 1, before "supply" insert --supplied to said air chamber, and means for precluding the--.

Signed and Sealed this

Sixth Day of September, 1994

*Attest:*

*Attesting Officer*

BRUCE LEHMAN

*Commissioner of Patents and Trademarks*